United States Patent [19]

Kozlowski et al.

[11] 4,054,625

[45] Oct. 18, 1977

[54] PROCESS FOR MAKING FIBERS

[75] Inventors: John H. Kozlowski, Vancouver; Paul C. Litzinger; Frank J. Steffes, both of Camas, all of Wash.

[73] Assignee: Crown Zellerbach Corporation, San Francisco, Calif.

[21] Appl. No.: 391,709

[22] Filed: Aug. 27, 1973

Related U.S. Application Data

[63] Continuation-in-part of Ser. No. 285,386, Aug. 30, 1972, abandoned.

[51] Int. Cl.[2] ..... B22D 23/08; D21F 11/00

[52] U.S. Cl. ..... 264/13; 162/157 R; 264/140; 264/205

[58] Field of Search ..... 260/29.6 AN; 264/211, 264/176 F, 204, 13, 140, 205; 159/48; 162/157 R

[56] References Cited

U.S. PATENT DOCUMENTS

| | | | |
|---|---|---|---|
| 2,733,978 | 2/1956 | Jones et al. | 264/182 |
| 2,870,113 | 1/1959 | Jones | 260/34.2 |
| 3,227,794 | 1/1966 | Anderson et al. | 264/205 |
| 3,308,211 | 3/1967 | Plastridge | 264/5 |
| 3,377,323 | 4/1968 | Ioka et al. | 260/75 T |
| 3,386,488 | 6/1968 | Ratzech et al. | 264/5 |
| 3,402,231 | 9/1968 | Bynam et al. | 264/210 F |
| 3,431,242 | 3/1969 | Waters et al. | 260/67 |
| 3,542,715 | 11/1970 | White et al. | 260/2.5 |
| 3,560,425 | 2/1971 | Wolinski | 260/29.6 AN |
| 3,630,986 | 12/1971 | Mison et al. | 260/34.2 |
| 3,674,628 | 7/1972 | Fabre | 161/178 |
| 3,770,663 | 11/1973 | Ueki et al. | 260/37 N |
| 3,770,853 | 11/1973 | Ueki et al. | 264/205 |
| 3,774,387 | 11/1973 | Woodell | 57/140 R |
| 3,808,091 | 4/1974 | Aoki et al. | 162/157 R |
| 3,902,957 | 9/1975 | Kozlowski | 162/157 R |
| T896,051 | 3/1972 | Hamlin et al. | 260/29.6 NR |

FOREIGN PATENT DOCUMENTS

| | | | |
|---|---|---|---|
| 2,144,409 | 3/1972 | Germany | 264/176 F |

OTHER PUBLICATIONS

"Man-Made Fibers", Moncrieff, pp. 434, 435 and 439; John Wiley & Sons.

*Primary Examiner*—Jay H. Woo

*Attorney, Agent, or Firm*—Stanley M. Teigland; Corwin R. Horton

[57] ABSTRACT

A process of manufacturing fibers by forming a mixture of a solvent, a polymer and water and flashing the mixture through a nozzle. Water is present as a discontinuous phase in the mixture. The polymer may be any polymer capable of forming fiber, preferably a crystalline or a partially crystalline polymer. The preferred polymers are crystalline or partially crystalline polyolefins, preferably polyethylene or polypropylene. The discrete fibers thus formed can be easily refined and used for making paper webs.

24 Claims, No Drawings

PROCESS FOR MAKING FIBERS

CROSS REFERENCE TO THE RELATED APPLICATION

This is a continuation-in-part of copending application No. 285,386, filed Aug. 30, 1972, now abandoned.

BACKGROUND OF THE INVENTION

In the past, various processes have been proposed for the manufacture of synthetic polymer fibers by the general technique of combining such polymers with various vaporizable liquids and, at elevated temperature and pressure, passing such mixtures through a nozzle into a zone of lower pressure (i.e. "flashing" such mixture). In such processes, for example those described in U.S. Pat. No. 3,081,519, British Pat. No. 1,262,531 and German Offenlegungsschrift 1,958,609, polymer solutions are formed with various solvents and such solutions are flashed to form fibers. In other processes, such as those described in German Offenlegungsschrift 2,147,461 and U.S. Pat. No. 3,402,231 a molten polymer is dispersed in water, optionally together with a very minor amount of solvent for the polymer and this mixture is flashed to form fibers. In yet another process, such as described in French Pat. No. 1,350,931, a minor amount of water is dispersed in a molten polymer and this mixture is flashed to form fibers.

However, all of the foregoing processes have practical shortcomings with respect to the quality of the fiber which may be produced and they all suffer from various inherent economic disadvantages. In an attempt to overcome these disadvantages, yet other processes have been proposed, such as described in German Offenlegungsschriften 2,121,512 and 2,144,409 and in U.S. Patent Application No. 295,339 filed Oct. 5, 1972, commonly assigned with the present application, in which an emulsion of a polymer solution in water is flashed to form fibers. While such processes are capable of producing improved fiber in comparison with the previously mentioned processes, the fiber produced still has limited strength properties and it is therefore desirable to provide improved processes which are capable of producing fiber with superior strength and other properties.

BRIEF DESCRIPTION OF PRESENT INVENTION

The present invention has as its object providing an improved process for the formation of discrete fibers that are especially suitable for making synthetic paper webs by conventional paper-forming techniques, preferably by the waterlaying technique. Applicants have found that fibers may be obtained by flashing an emulsion of polymer, solvent and water which are better in important properties when the solvent is the continuous phase and water the disperse phase, than when water is the continuous phase and the solvent the disperse phase.

An inverse (water-in-oil) emulsion, wherein water is the disperse phase, is generally more difficult to form than the emulsions most commonly encountered in emulsion technology which are oil-in-water emulsions, and Applicants have established that it is possible to form and flash water-in-oil emulsions containing a polymer, and that flashing an inverse emulsion produces very good fibers.

It is a surprising effect of flashing a water-in-oil emulsion containing a polymer, that the product is obtained as relatively discrete fibers rather than continuous integral strands. Most prior processes tend to form continuous strands, which is undesirable for a fibrous product whose intended use is for making non-woven webs.

Thus, the present process comprises firstly, forming a mixture containing (i) a polymer, preferably a thermoplastic polymer, (ii) an organic liquid capable of dissolving or swelling the polymer and (iii) water and secondly flashing the mixture, at a temperature at least sufficiently high that the polymer is swollen by the liquid, from a zone of elevated pressure into a lower pressure zone whereby the organic liquid evaporates and the polymer precipitates in the form of fibers which can be refined with relative ease and formed into paper webs by conventional techniques. The present process is characterized in that the water is mixed with the polymer and liquid so that the water is dispersed as droplets in a continuous phase comprising the polymer and organic liquid. Preferably the polymer is dissolved in the liquid, so that the mixture is formed in the first step of the process and which is flashed in the second step comprises an emulsion having the water as the disperse phase and the solution as the continuous phase.

It has been found that the fibers produced by the present process tend to have properties at least as good as fibers produced by flashing a comparable mixture wherein the polymer solution is the dispersed phase in the water.

DESCRIPTION OF PREFERRED EMBODIMENTS

In practicing the process of the present invention, any polymer or copolymer may be employed which is capable of forming fibers by conventional spinning techniques. Thermoplastic fiberforming polymers are preferred, particularly crystalline or partially crystalline polyolefins such as low pressure (Ziegler-Natta) polyethylene, isotactic or partically isotactic polypropylene, and ethylene-propylene copolymers. Additionally, polybutenes and polymethyl pentenes may be employed in the practice of this invention. Crystalline or partially crystalline polyamides and polyesters may also be used. Noncrystalline polymers such as polycarbonates, polyacrylonitrile and polystyrene may be used. Mixtures of the foregoing with each other or other polymers may also be employed.

The preferred polyolefins employed are those having an intrinsic viscosity above about 0.7 dl/g, which for polyethylene corresponds to a viscosity average molecular weight of about 30,000 to 40,000.

The polymers employed in practicing the present process may be in the form of dried powder or pellets or, preferably, as wet cake, slurry or solution of polyolefin in the reaction solvent as obtained after polymerization.

Generally, any substituted or unsubstituted aliphatic, aromatic or cyclic hydrocarbon which is a solvent for the polymer at elevated temperatures and pressures, which is relatively inert under the conditions of operation, which preferably has a boiling point at atmospheric pressure that is less than the softening point of the polymer and which is substantially immiscible in water or forms a polymer solution which is substantially immiscible in water may be employed in practicing the present process. The solvent may be liquid or gaseous at room temperature and atmospheric pressure although it is preferred that it be liquid at such conditions as otherwise the system after the flashing zone may have to be pressurized. Illustrative of the solvents which may be utilized are aromatic hydrocarbons, e.g. benzene and toluene; aliphatic hydrocarbons, e.g., butane, pentane, hexane, heptane, octane and their isomers and homologues; alicyclic hydrocarbons, e.g., cyclohexane; chlorinated hydrocarbons, e.g. methylene chloride; higher alcohols; esters; ethers; ketones; nitriles; amides; fluorinated compounds, e.g. fluoro-hydrocarbons; nitromethane; and mixtures of the above solvents or other solvents.

The polymer-solvent-water mixture of the present invention may be formed by any one of several methods. One may start with a solution of polymer in solvent as it comes from a solution polymerization process, either at the same concentration, diluted or concentrated, and then add the water to the solution or vice versa in some cases as will be described below. Generally, in such a procedure hot water is employed to prevent precipitation of the polymer. Alternatively, under appropriate conditions, one may start with a slurry of polymer particles in the solvent such as is produced by a slurry polymerization procedure and the appropriate amount of water is added to the slurry or vice versa. A further alternative would be to start with a dry polymer powder, or granules, or a wet cake such as might be produced at some stage of solvent removal in the polymer plant, and the appropriate amounts of solvent and water are admixed therewith in the desired order.

It has been found to be advantageous to have the solvent present prior to water addition since the solvent or polymer solution will form the continuous phase of the mixture to be formed. This latter approach is important when one employs an amount of water which is near the borderline of an inversion occuring, i.e. at the point where the amount of water is approaching that level where it would form the continuous phase. When the amount of water is substantially below the borderline of an inversion occurring, particularly below 30% by volume of the mixture, then any convenient method of mixing or order of addition of materials may be employed.

The polymer concentration relative to the solvent is not critical, the solvent being present in an amount that is greater than 100% by weight of the polymer and sufficient to give a viscosity at the dissolution temperature employed that can be easily handled, i.e., a viscosity less than about 500 poises. Generally the polymer concentration will vary from about 2% to about 30% by weight of the solvent plus polymer, and preferably is in the range of about 5% to about 15%.

One of the functions of the water is to reduce the temperature of the fibrous mass in the zone immediately following the nozzle. The addition of water increases the total vapor pressure of the system, thus reducing the boiling point thereof. As a practical matter, water would be employed in the amount of at least about 1%, and preferably above 10% by volume of the solvent-water mixture. By thus lowering the boiling point of the mixture, the temperature of the fibrous mass formed upon flashing is reduced and the properties of the resulting fiber enhanced for papermaking uses.

Another function of the water is to act as the carrier for a hydrophilic water-dispersing agent for the fibers to be formed. It has been found that it is most advantageous to have the water dispersing agent present during flashing and precipitation of the fibrous polymer. An equivalent amount of the same agent added at a later stage to the already formed fibers does not give the same degree of refinability of the fibers. Therefore, the water should be present in an amount sufficient to carry that amount of the hydrophilic agent employed to impart to the fibrous polymer the desired level of water dispersibility, preferably as a solution thereof. Additional water above such minimum amount required to carry the agent may be employed to impart a suitable viscosity to the aqueous solution or dispersion agent, i.e., the aqueous solution of the water-dispersion agent should not be so viscous as to present problems of handling or incorporation into the polymer solution as a dispersed phase. Also, the water can aid in reducing the viscosity of the mixture to a level less than that of the polymer solution alone, thus permitting higher polymer concentrations. Generally, the viscosity of the aqueous solution and/or the mixture should be less than about 500 poises at the temperature employed.

A further function of the water is to provide energy to aid the vaporization of the solvent during flashing since it is not desirable to have the temperature so high that there is sufficient energy imparted to the solvent alone to effect its complete vaporization. However, the amount of water should not be so great as to require the expenditure of unnecessary heat values in attaining the desired flashing temperature, i.e., once that amount of water required to form an aqueous solution or dispersion of the agent having a suitable viscosity is determined, additional water may be employed to a certain extent since it helps to lower the mixture viscosity and aids the solvent vaporization but the additional amount need not be great.

The amount of water required to perform the foregoing functions is always less than that amount at which an inversion occurs, i.e., where water becomes the continuous phase of the mixture. One condition necessary to ensure that the organic liquid or solution is the continuous phase is that the proportion of water in the mixture be fairly low. If the proportion of water is more than about 70%, it is very difficult to form a water-in-oil emulsion even if one tries. Even at somewhat lower proportions of water, say in excess of 60% water, any usual method of mixing will tend to produce an oil-in-water emulsion. As the proportion of water becomes less, it becomes easier to form a water-in-oil emulsion. In mixtures where water would tend to be more stable as the continuous phase it is desirable to utilize special mixing techniques in order to establish the water as the less stable discontinuous phase. Appropriate techniques are familiar to the emulsion technologist and are described in, for example, Volume 8 of Kirk-Othmer Encyclopedia of Chemical Technology, Second Revised Edition, 1965.

In such mixtures where the water is more stable as the continuous phase it is desirable to utilize the mixing techniques mentioned previously in order to establish the water as the less stable discontinuous phase. Thus a preferred method for ensuring a water-in-oil emulsion when the proportion of water is sufficient that either water of the organic liquid could be the continuous phase is to add the water to the liquid at a rate sufficiently slow that even at the point of addition there is no local excess of water over organic liquid and already-formed emulsion, while agitating the mixture so as to break up the water into droplets. One can keep the addition of water sufficiently gradual by measuring the electrical conductivity to see that the rate of addition, under given conditions of agitation, is such that the conductivity remains less than twice the initial conductivity.

As a useful guide, it is desirable to utilize such special mixing techniques where the water is to be about 30% by volume or more of the mixture. Specifically, when the amount of water employed is about 30% by volume or above, it is desirable to first form a solution of the polymer and solvent and then add water to this solution with vigorous agitation. In this respect the term "polymer solution" is intended to mean the swollen or dissolved mixture resulting from the blending of the solvent with the polymer, usually at an elevated temperature. It is further desirable that the entire mass of the mixture be continuously subject to such agitation both during and following water addition. The mixing vessel or apparatus may be designed to impart such uniform and vigorous agitation, e.g., by appropriate vessel configuration, baffles and stirring techniques. In this manner regions of very low agitation, which could cause phase inversion, may be avoided.

It is preferable to carry out this mixing procedure while both the water and the polymer solution are relatively hot. Desirably, the polymer solution should be at a temperature above the melt dissolution temperature and the water to be added should be at a temperature high enough such that the mixture remains above such melt dissolution temperature during and after water addition. This procedure will help prevent phase inversion during water addition.

If the water and polymer solution phases are permitted to separate during or after addition of the water a phase inversion may occur. Therefore, it is desirable to add the water at a rate which will avoid phase separation and to maintain vigorous agitation during and following water addition for the same purpose. As mentioned previously the water is preferably added gradually at a rate such that it quickly becomes uniformly mixed with the polymer solution. That is, the water should be added no faster than it is dispersed as droplets in the continuous polymer-solvent phase.

When the mixture comprises about 30% or less of water, a water-in-oil emulsion is preferentially formed, and it is not even necessary to add the water to the organic liquids. At low concentrations of water, one can even mix the two liquids and then agitate them, or add the solution (or a slurry of polymer particles in organic liquid) to the water.

Thus in the following examples 1-6, where the water concentration was only 16%, no special mixing procedures were followed. In Run No. 1 of Example 7, where the water concentration was 40%, the water was added gradually to the solution. Water concentrations of the order of 40-50%, are in fact preferred for the present process, even through more care has to be exercised to ensure that water is the discontinuous phase.

In a continuous flashing operation, as a portion of the mixture thus formed is flashed through a nozzle, asditional quantities of polymer solution and water may be continuously added with agitation to the remaining mixture in proper proportions as discussed previously, to maintain the water as the discontinuous phase in the mixture.

One of the features of the present invention is that it has been found that it is not necessary to form a stable "emulsion" thereby eliminating the necessity for emulsifiers to be used. However, the present invention does contemplate the employment of agents in the mixture in order to promote water dispersibility of the fibrous polymer formed upon flashing. These agents are preferably water-soluble or partially water-soluble high molecular weight materials. However, they may also be materials which are soluble or partially soluble in the solvent. Some of these agents may be technically classified as "emulsifiers", but they are only employed in an amount sufficient to impart the requisite degree of dispersibility and not in amounts generally required to form a stable emulsion. In fact, since the water dispersion agents have to be somewhat hydrophilic they are not the type one would normally employ in forming a water-in-oil type emulsion, i.e., one would normally employ a hydrophobic (lipophilic) emulsifier having a relatively low HLB (hydrophilic-lipophilic balance) to form a water-in-oil emulsion. The amount of water-dispersing agent employed may range from about 0.1% to about 15% by weight of the polymer, preferably from about 0.1% to about 5% by weight. The preferred water-dispersing agent is a polyvinyl alcohol having a degree of hydrolysis greater than about 77% and preferably greater than about 85%, and having a viscosity (in a 4% acqueous solution at 20° C) greater than about 2 centipoises. The polyvinyl alcohol is preferably added with the water at the time the mixture is formed. Illustrative of other water-dispersing agents that may be employed are cationic guar, cationic starch, potato starch, methyl cellulose and Lytron 820 (a styrene-maleic acid copolymer).

The ingredients of the mixture can be placed in any suitable vessel which is capable of being heated to an elevated temperature and pressure. Generally, an autoclave is employed. It is important, however, that the vessel employed be equipped with a mixing or stirring device capable of keeping the mixture in a constant state of agitation since a stable emulsion is not formed and upon standing the mixture will quickly separate into two distinct and separate phases.

The ingredients are then heated to a suitable temperature and agitated to form a mixture wherein water is present as a discontinuous or dispersed phase within the continuous phase of polymer solution. The temperature employed is preferably above the melt dissolution temperature of the polymer in the solvent employed. The melt dissolution temperature of any particular polymer in a solvent is determined by placing low concentrations of the polymer (e.g., 0.1 and 1.0% by weight) into the solvent in a vial which is then sealed and placed in an oil bath. The temperature of the oil bath is raised slowly (e.g. 10° C/hour) until the last trace of polymer disappears. This temperature is the melt dissolution temperature. In some instances it may be desirable to operate at a temperature below the melt dissolution temperature, in which case the polymer should be present in at least a swollen state.

The maximum temperature employed should be less than the critical temperature of the solvet and/or the decomposition temperature of the polymer. However, it is preferred to use somewhat lower temperatures. For polyethylene and polypropylene it is preferred to operate between about 120° C and about 180° C most preferably between about 130° and 160° C.

The pressure employed in the vessel containing the heated mixture is preferably substantially autogeneous. Pressures substantially higher than autogeneous are not required and, for a given nozzle configuration, may result in poor fiber formation. It may be desirable to employ an inert gas such as nitrogen during the flashing operation to maintain the velocity of the mixture through the nozzle at a fairly constant level.

Flashing is preferably effected through a nozzle (which, by definition, has a longitudinal dimension) rather than a sharp-edged orifice (which, by definition, has no longitudinal dimension) because it has been found that it is highly desirable to impart shear to the mixture (particularly the polymer component thereof) immediately prior to flashing. Such shearing action aids fiber formation and enhances fiber properties for papermaking purposes. The nozzle may be circular or noncircular in cross-section and may be an annulus.

The flashing is effected by passing the mixture of polymer, solvent and water through the nozzle into a zone of lower pressure. Preferably, the pressure of the lower pressure zone is substantially atmospheric or below as the higher the pressure, the higher the temperature of the fibrous product upon formation. Generally, the pressure of the emulsion before it is flashed to the lower pressure zone should be below about 50 psig, preferably below about 15 psig.

Flashing is carried out substantially adiabatically, although this can be varied somewhat.

During flashing, the polymer is precipitated as a fibrous "noodle", which is a loose aggregation of fibers which is sometimes continuous.

In a preferred embodiment of the present invention, low pressure (less than about 20 psi) steam is added to the fibrous noodle in the post flashing zone to strip the residual solvent from the fibrous noodle. This can be accomplished in a tank or, preferably, in a conduit immediately following the nozzle.

The fibrous noodle is collected in suitable receiving vessel preferably one which permits the vaporized solvent to be separated therefrom.

In commerical operation the fibrous noodle is diluted with water to a suitable consistency less than about 5% and preferably less than 2% by weight and then passed as an aqueous slurry through a disk refiner in order to place the fibers in a form optimally suitable for papermaking. The refining of the fibrous noodle separates discrete fibers and also may be used in controlling the length of the fibers. Multiple passes through the refiner is generally desirable. Disc refining of the fibrous noodle is not essential for some uses of the fibrous product, however.

The fibers after refining may be diluted to a suitable consistency and made into synthetic paper webs, either alone or blended with normal cellulose papermaking fibers. Alternatively, the fibers can be dewatered, pressed into bales, stored and shipped to the ultimate users.

While the foregoing description illustrates a batch process in which the mixture of polymer, solvent and water is prepared in a suitable vessel, it is also possible to prepare the mixture on a continuous basis by blending the polymer solution with superheated water continuously in an in-line mixing device, jusr prior to flashing through the nozzle.

A determination of whether the water is present as a discontinuous phase or a continuous phase can be made in the following manner. The mixture is formed at the appropriate temperature and pressure and with the degree of stirring that would be normally employed. Electrodes consisting of two conducting metals separated by a distance of about one-half inch or more are immersed in the liquid mixture. The electrodes are connected to the poles of a battery and the signal generated registered by a recorder connected in series with the electrodes. The signal produced is directly proportional to the conductance of the mixture. A trace amount of an ionizable material such as sodium chloride may be employed in the water to aid the conductivity thereof. Where water is the discontinuous phase, a very low conductance reading or a zero conductance reading is obtained, i.e. approximately the same conductivity as the polymer-solvent phase of the mixture.

It can thus be seen that in forming the desired water-discontinuous mixture, the agitation rate of the mixture is desirably high enough to maintain the conductivity of the mixture at approximately the conductivity of the polymer solution phase. Similarly, in forming such mixtures where the water concentration is desirably so high that a water-continuous system is favored, the water should be added to the polymer solution at a gradual enough rate to maintain the conductivity of the mixture at approximately the conductivity of the polymer solution phase.

Other suitable methods of determining whether an oil-in-water or a water-in-oil type emulsion is obtained are described on pages 146 and 147 of Volume 8 of Kirk-Othmer Encyclopedia of Chemical Technology, Second Revised Edition, 1965.

EXAMPLE 1.

The dissolution vessel employed in this example was an 800-gallon, glass-lined, baffled tank having a centrally disposed 7.5 horsepower agitator having two 4-bladed turbine-type stirrers located thereon. The lower turbine was 27 inches from tip-to-tip and the upper turbine was 19 inches from tip-to-tip. The stirrer was operated throughout the run. Sixty gallons of water containing 1% by weight polyvinyl alcohol (Monsanto Gelvatol, viscosity of 4–6 CP and 87.7–89% hydrolyzed) based on the weight of the polyethylene to be employed was added to the tank, followed by the addition of 45.4 kg of high density polyethylene having an intrinsic viscosity of 1.4 dl/gram and a melt index of 5.5 (Mitsui2200P). The vessel was sealed, and 300 gallons of n-hexane added. The water-to-hexane volume ratio in the mixture was 1:5, and the polyethylene concentration was 40 grams per liter of hexane. The contents of the vessel were then heated to 130°–135° C and a pressure of 120 psig. A valve in the bottom of the vessel was then opened and the mixture fed through a 3-inch line five inches in length to a Valtek angle-type control valve having a port with a diameter of 9.5 mm and a length of 7 mm. A nipple-shaped plug in the valve port formed an annulus with the wall of the port. The valve was operated about one-quarter open. The mixture flowed through the annulus which formed the flash nozzle at the rate of 180 grams of polyethylene per minute. The mixture flashed into a line having a diameter of 1 inch. At a distance of about 6 inches past the nozzle, low pressure (10 psig) steam was introduced into the 1-inch line to strip the solvent which had not previously flashed from the fibrous noodle. At a distance of about 18 feet from the nozzle the 1-inch line opened into a vapor-separation vessel, the vapors being removed from the top of the vessel. Hot dilution water at 85° C was introduced at the top of the vapor-separation vessel at a rate of about 5 gallons per minute. The water and fibrous noodle dropped to the bottom of the vapor-separation vessel, and was fed at temperature of 80° C – 90° C and a consistency of about 1% to a Jones double disc refiner (12-inch diameter discs) equipped with brushingtype plates (Jones type 1, 1, 1.5, + 10°). The discs were operated at 2117 rpm at a clearance of 0.004 ± 0.004 inch. The fibers were subjected to a total of four passes through the refiner, the second through fourth passes being at a stock temperature of 40°-50° C. And additional 1% by weight Gelvatol 20-30 polyvinyl alcohol (based on the polyethylene) was added to the stock tank and the stock given a fifth refiner pass with the plates set at 0.010 ± 0.004 inch. The polyethylene fibers had the following fiber fractionation when tested according to TAPPI Standard T233 su 64:

Table 1A

| Mesh | Weight |
|---|---|
| On 20 | 10.3 |
| On 35 | 33.8 |
| On 65 | 23.8 |
| On 150 | 17.4 |
| On 270 | 5.0 |
| Through 270 | 9.7 |

The fibers had a drainage factor of 0.24 seconds/-gram.

One portion of the resulting fibers was made into handsheets in accordance with TAPPI Standard T-205 m-58 with modified wet pressing (400 psi) and a heat-bonding step (121° C at minimum pressure). Another portion of the fibers was blended 50/50 with bleached alder kraft pulp having a Canadian Standard Freeness of 410 cc and made into handsheets by the same procedure. The resulting handsheets were tested and the results are as follows:

Table 1B

| Property | 100% | 50% Blend |
|---|---|---|
| Basis Weight, gm/m² | 61.2 | 61.2 |
| Density, gm/cc | 0.36 | 0.48 |
| Opacity, % | 83.4 | 78.9 |
| Brightness, % (Elrepho No. 8) | 88.9 | 84.4 |
| Breaking Length, m | 139 | 2416 |
| TEA, kg-cm/cm² | 0.06 | 34.3 |
| Internal Bond, Scott Units | 14 | 90 |
| Tear, gm/sheet | 6 | 28 |

A further portion of the polyethylene fibers was blended with a bleached alder kraft pulp having a Canadian Standard Freeness of 410 cc to provide a furnish containing 40% by weight polyethylene fibers and 60% by weight kraft fibers. The resulting blend was Jordan-refined to provide a furnish having a Canadian Standard Freeness of 250 cc, and formed into paper on a paper machine. The paper machine was operated to provide two levels of heat-bonding (107° and 135° C on the sheet). The resulting paper webs had the following characteristics:

Table 1C

| Property | | Heat Bonding Temperature 107° C | 135° C |
|---|---|---|---|
| Basis Weight, g/m² | | 66.6 | 63.3 |
| Caliper, mm | | 0.132 | 0.11 |
| Density, g/cc | | 0.504 | 0.573 |
| Tear, g/sheet | MD | 23 | 24 |
| | XD | 26 | 27 |
| Tensile, kg/15 mm | MD | 2.93 | 3.11 |
| | XD | 1.49 | 1.70 |
| Stretch, % | MD | 1.6 | 1.7 |
| | XD | 3.5 | 3.8 |
| TEA, kg-cm/cm² | MD | 0.019 | 0.020 |
| | XD | 0.025 | 0.032 |
| Fold (MIT) | MD | 3 | 7 |
| | XD | 2 | 3 |
| Stiffness, g/cm (Taber) | MD | 1.17 | 0.96 |
| | XD | 0.46 | 0.45 |
| Scott Internal Bond kg-cm/cm² × 10⁻³ | | 152 | 285 |
| Smoothness, cc/min | WS | 328 | 327 |

Table 1C-continued

| Property | | Heat Bonding Temperature 107° C | 135° C |
|---|---|---|---|
| (Sheffield) | FS | 352 | 293 |
| Porosity cc/min (Sheffield) | | 249 | 278 |
| Oil Absorption, % | | 45 | 32 |
| Sugar Dye, sec. | WS | 0 | 2.1 |
| | FS | 0 | 1.6 |
| Brightness, % (Elrepho No. 8) | | 85.4 | 80.9 |
| Opacity, % | | 80.4 | 69.1 |
| Scattering Coefficient | | 408 | 253 |
| Breaking Length, m | MD | 2931 | 3271 |
| | XD | 1492 | 1786 |

Note
WS = wire side MD = machine direction
FS = felt side XD = cross machine direction In the foregoing example and subsequent-examples, the basis weight, caliper, tear, fold, and density of the handsheet properties, were determined by TAPPI Standard T-220. For the sheets made on the paper machine, the basis weight was determined by TAPPI Standard T-410, the caliper by TAPPI Standard T-411, the tear by TAPPI Standard T-410, the fold by TAPPI Standard T-511, and the density by TAPPI Standard T-426. The tensile strength, stretch, TEA (tensile energy absorption) and breaking length for both handsheets and paper machine sheets were determined by TAPPI Standard T-494. Stiffness for both sheets was determined by TAPPI Standard T-489-70. Elrepho No. 8 brightness for both sheets was determined by TAPPI Standard T-525. The smoothness for both sheets was determined by TAPPI Routine Control Method No. 285. The oil absorption was determined for both sheets by TAPPI Routine Control Method No. 26 (1966). Opacity and scattering coefficient was determined for both sheets by TAPPI Standard T-425. Other tests are indicated by the machine used to perform tests, which are all well known in the paper industry. The drainage factor, which is highly correlated to the hydrodynamic surface area of the fibers and is more closely related to the drainage characteristics of fibers to be used in papermaking than gas adsorption surface area, was determined substantially in accordance with TAPPI Test T221 OS-63 with a slight modification in the method of calculation. Briefly, approximately 10 grams of a fiber sample is weighed and dispersed in water. The slurry is then added to the standard sheet mold and water added to the mark. The slurry is stirred by four up-and-down strokes of the standard stirrer, which is then removed. The water temperature in the mold is measured and the drainage valve opened. The time between the opening of the valve and the first sound of suction noted. The procedure is repeated with water only (no fiber) in the sheet mold and the temperature and drainage time note. The drainage factor in seconds per gram is then calculated as follows:

$$DF = \frac{[D+0.3\,(\frac{1}{V_T}-1)\,(D-4)] - [d+0.3\,(\frac{1}{V_T}-1)\,(d-4)]}{W}$$

where

DF = drainage factor, seconds/gram
D = drainage time with pulp in mold, seconds
d = drainage time without pulp in mold, seconds
$V_T$ = viscosity of water at temperature T
W = weight of fibers employed in test, grams The quantity $((1/V_T) - 1)$ is tabulated in the aforementioned TAPPI Test T221 OS-63. This quantity is multiplied by 0.3 which has been empirically determined for the present fibers.

EXAMPLE 2

The procedure of Example 1 was repeated except as follows:

a. The polyethylene concentration was 80 grams/-liter;

b. The mixture passed through the nozzle at the rate of 250 grams per minute; and c. The refining conditions were as follows:

1. The first pass was at 80°-90° C with a plate clearance of 0.004 inch;
2. The second through sixth passes were at 40°-50° C with a plate clearance of 0.004 inch.

No additional polyvinyl alcohol was added

The resulting fibers had the following fiber fractionation:

Table 2A

| Mesh | Weight % |
|---|---|
| On 20 | 6.4 |
| On 35 | 33.5 |
| On 65 | 29.2 |
| On 150 | 17.4 |
| On 270 | 6.3 |
| Through 270 | 7.2 |

The drainage factor of the fibers was 0.46 seconds/-gram.

Handsheets were made as in Example 1, one group containing 100% polyethylene fibers and one group being made from a 50/50 blend with the bleached alder kraft described in Example 1. The properties were as follows:

Table 2B

| Property | 100% | 50% Blend |
|---|---|---|
| Basis Weight, gm/m² | 63.5 | 63.4 |
| Density, gm/cc | 0.36 | 0.44 |
| Opacity, % | 90.3 | 84.7 |
| Brightness, % (Elrepho No. 8) | 92.2 | 86.0 |
| Breaking length, m | 145 | 2036 |
| TEA, gm-cm/cm² | 0.06 | 29.8 |
| Internal Bond, Scott Units | 25 | 82 |
| Tear, gm/sheet | 3 | 30 |

A portion of the fibers were blended with the bleached alder kraft described in Example 1 (40% by weight polyethylene fibers, 60% by weight kraft) and made into a paper web on a paper machine at two levels of heat-bonding as in Example 1. The properties of the resultant web were as follows:

Table 2C

| Property | | Heat Bonding Temperature 107° C | 135° C |
|---|---|---|---|
| Basis Weight, g/m² | | 66.6 | 63.3 |
| Caliper, mm | | 0.132 | 0.11 |
| Density, g/cc | | 0.504 | 0.573 |
| Tear, g/sheet | MD | 23 | 24 |
| | XD | 26 | 27 |
| Tensile, kg/15 mm | MD | 2.93 | 3.11 |
| | XD | 1.49 | 1.70 |
| Stretch, % | MD | 1.6 | 1.7 |
| | XD | 3.5 | 3.8 |
| TEA, kg-cm/cm² | MD | 0.019 | 0.020 |
| | XD | 0.025 | 0.032 |
| Fold (MIT) | MD | 3 | 7 |
| | XD | 2 | 3 |
| Stiffness, g/cm (Taber) | MD | 1.17 | 0.96 |
| | XD | 0.46 | 0.45 |
| Scott Internal Bond kg-cm/cm² × $10^{-3}$ | | 152 | 285 |
| Smoothness, cm/min | WS | 328 | 327 |

Table 2C-continued

| Property | | Heat Bonding Temperature 107° C | 135° C |
|---|---|---|---|
| (Sheffield) | FS | 352 | 293 |
| Porosity, cc/min (Sheffield) | | 249 | 278 |
| Oil Absorption, % | | 45 | 32 |
| Sugar Dye, sec. | WS | 0 | 2.1 |
| | FS | 0 | 1.6 |
| Brightness (Elrepho No. 8) | | 85.4 | 80.9 |
| Opacity, % | | 80.4 | 69.1 |
| Breaking Length, m | MD | 3155 | 3714 |
| | XD | 1553 | 1900 |

EXAMPLE 3

The procedure of Example 1 was repeated except as follows:

a. The polyethylene concentration was 80 grams/-liter;

b. The mixture passed through the nozzle at 150 grams per minute; and c. The refining conditions were as follows:

1. The first pass was at 80°-90° C with a plate clearance of 0.002 ± 0.004 inch;
2. The second through sixth passes were at 20° C with a plate clearance of 0.002 ± 0.004 inch. No additional polyvinyl alcohol was added.

The resulting fibers had the following fiber fractionation:

Table 3A

| Mesh | Weight |
|---|---|
| On 20 | 2.3 |
| On 35 | 21.2 |
| On 65 | 32.7 |
| On 150 | 26.2 |
| On 270 | 9.0 |
| Through 270 | 8.6 |

The drainage factor of the fibers was 1.10 seconds/-gram.

Handsheets were made as in Example 1, one group containing 100% polyethylene fibers and one group made from a 50/50 blend with the bleached alder kraft described in Example 1. The properties were as follows:

Table 3B

| Property | 100% | 50/50 Blend |
|---|---|---|
| Basis Weight, gm/m² | 62.2 | 62.3 |
| Density, gm/cc | 0.41 | 0.50 |
| Opacity, % | 93.7 | 88.2 |
| Brightness, % (Elrepho No. 8) | 93.7 | 88.4 |
| Breaking Length, m | 305 | 2534 |
| TEA, gm-cm/cm² | 2.4 | 47.6 |
| Internal Bond Scott Units | 20 | 82 |
| Tear, gm/sheet | 5 | 29 |

A portion of the fibers was blended with the bleached alder kraft described in Example 1 (40% by weight polyethylene fibers, 60% by weight kraft) and made into a paper web on a paper machine at two levels of heat-bonding as in Example 1. The properties of the resultant web were as follows:

Table 3C

| Property | Heat Bonding Temperature 107° C | 135° C |
|---|---|---|
| Basis Weight, g/m² | 60.3 | 59.9 |
| Caliper, mm | 0.130 | 0.118 |
| Density, g/cc | 0.461 | 0.504 |

Table 3C-continued

| Property | | Heat Bonding Temperature 107° C | 135° C |
|---|---|---|---|
| Tear, g/sheet | MD | 31 | 31 |
| | XD | 33 | 36 |
| Tensile, kg/15 mm | MD | 2.85 | 3.65 |
| | XD | 1.39 | 1.80 |
| Stretch, % | MD | 1.6 | 1.7 |
| | XD | 3.8 | 3.5 |
| TEA, kg-cm/cm² | MD | 0.019 | 0.025 |
| | XD | 0.027 | 0.034 |
| Fold (MIT) | MD | 5 | 12 |
| | XD | 2 | 7 |
| Stiffness, g/cm (Taber) | MD | 1.2 | 1.1 |
| | XD | 0.51 | 0.56 |
| Scott Internal Bond, kg-cm/cm² × $10^{-3}$ | | 147 | 466 |
| Smoothness, cc/min (Sheffield) | WS | 329 | 363 |
| | FS | 325 | 346 |
| Porosity, cc/min (Sheffield) | | 265 | 400 |
| Oil Absorption, % | | 53 | 35 |
| Sugar Dye, sec. | WS | 0 | 14.6 |
| | FS | 0 | 16.9 |
| Brightness, % (Elrepho No. 8) | | 87.4 | 79.5 |
| Opacity, % | | 85.9 | 65.4 |
| Breaking length, m | MD | 3152 | 4068 |
| | XD | 1543 | 2108 |

EXAMPLE 4

In this example, the vessel employed in preparing the mixture for flashing was a Benco Model 575 one-gallon reactor equipped with 150 psi steam jacketing, an inlet and outlet for nitrogen, and a centrally located air-driven agitator shaft with a mechanical seal. A 4-inch diameter, 6-blade pitched blade turbine (Bench Scale Equipment Co.) was positioned about five inches from the bottom of the vessel on the shaft and a high shear impeller was positioned about three and one-half inches below the turbine. The vessel was equipped with four equidistantly spaced vertical baffles. The vessel was equipped with an electrode consisting of a piece of metal wire sealed through one end of a short length of glass tubing. The other end of the wire was pushed through a 12-inch length of stainless steel tubing (¼ inch outside diameter) and the glass tube and metal tube were joined with a Swagelok union. The electrode was positioned in the vessel such that the wire was above the level of the water in the mixture described below. The wire was attached to one lead of an ohm meter in series with the battery. The stainless steel sleeve, which was separated from the wire by insulation along its entire length at a gap distance therebetween of approximately 15 mm, was connected to the other pole. It was determined that the signal for saline water alone was about 140 millivolts while the signal for n-hexane alone was about 0–1.0 millivolts. Exiting from the bottom of the vessel was a ¾ inch pipe having a ball valve located therein two inches below the vessel bottom. Immediately adjacent the ball valve was a nozzle. The nozzle consisted of a brass plug 104 mm in length with a centrally located hold 3.5 mm in diameter drilled therethrough. The nozzle plug was inserted in the ¾ inch piping which continued for a distance of about 12 inches past the nozzle and exited into the atmosphere. The vessel was charged with 500 ml of water; 2,500 ml of n-hexane; 100 grams of polyethylene (Mitsui 2200P described in Example 1), 2 grams of Gelvatol 20–30 polyvinyl alcohol, and 20 drops of a 25% acqueous sodium chloride solution. The vessel was sealed, purged with nitrogen and the contents heated to between 145°–150° C with the agitator operating at 650 rpm. The contents were held at 145°–150° C for about 1½ hours to insure complete polymer dissolution. The conductivity of the mixture was between 0.4 – 1.2 millivolts, showing that water was a discontinuous phase. The ball valve was then opened and the mixture passed through the nozzle while pressure was maintained constant in the vessel by nitrogen addition. The fibrous product was collected by impingement on a wire mesh screen. The fibers were refined by passing them at room temperature through a Sprout Waldron single disc refiner having 12 inch plates (Sprout Waldron Pattern C-29-78-B) operating at 2,800 rpm at a plate clearance of 0.002 inch a total of four pases.

The fiber fractionation of the resulting fibers was as follows:

Table 4A

| Mesh | Weight % |
|---|---|
| On 20 | 2.2 |
| On 35 | 18.8 |
| On 65 | 35.3 |
| On 150 | 24.6 |
| On 270 | 9.5 |
| Through 270 | 9.6 |

The drainage factor of the fibers was 4.3 seconds/-gram.

Handsheets were prepared as in Example 1, one group containing 100% polyethylene fibers, the other being prepared from a 50/50 blend with the bleached alder kraft described in Example 1. The properties were as follows:

Table 4B

| Property | 100% | 50/50 Blend |
|---|---|---|
| Basis weight, gm/m² | 58.6 | 63.3 |
| Density, gm/cc | 0.35 | 0.55 |
| Opacity, % | 95.3 | 89.5 |
| Brightness, % (Elrepho No. 8) | 95.3 | 88.4 |
| TEA, gm-cm/cm² | 0.009 | 0.06 |
| Scott Internal Bond kg-cm/cm² × $10^{-3}$ | 76.7 | 271.0 |
| Tear, gm/sheet | 8.8 | 29.6 |
| Tensile, kg/15 mm | 0.54 | 3.4 |
| Stretch, % | 3.4 | 3.7 |

EXAMPLE 5

Example 4 was repeated except that polyvinyl alcohol was omitted from the mixture. The conductivity of the mixture was the same as Example 4. The stirring was briefly stopped to check the electrode and the conductivity quickly increased to about 100 millivolts showing phase separation. Upon resumption of stirring, the conductivity quickly returned to 0.4 tpo 1.2 millivolts. The mixture was maintained at 140° C for ½ hour and then passed through the nozzle under a steady pressure of 165 psi. The fibers as produced could not be refined or made into handsheets until they had been treated with 1% by weight of the fibers of Gelvatol 20–30 polyvinyl alcohol by blending therewith in an acqueous slurry. The fibers, after treatment, were then refined as in Example 4 and had the following fiber fractionation:

Example 5A

| Mesh | Weight % |
|---|---|
| On 20 | 0.8 |
| On 35 | 11.7 |
| On 65 | 34.1 |
| On 150 | 31.4 |
| On 270 | 14.0 |
| Through 270 | 8.0 |

The fibers had a drainage factor of 16.5 seconds/-gram.

Handsheets were prepared in accordance with the procedure of Example 1, one group being prepared from 100% polyethylene fibers and the other from a 50/50 blend with the bleached alder kraft described in Example 1. The properties were as follows:

Table 5B

| Property | 100% | 50/50 Blend |
|---|---|---|
| Caliper, mls | 5.4 | 4.1 |
| Basis Weight, pounds/3000 ft² | 36.6 | 36.5 |
| Density, gm/cc | 0.43 | 0.57 |
| Opacity, % | 94.8 | 89.4 |
| Brightness, % (Elrepho No. 8) | 94.3 | 89.0 |
| TEA, ft-lb/ft² | 1.85 | 2.98 |
| Internal Bond, Scott Units | 60 | 102 |
| Tear, gm/sheet | 16.0 | 33.0 |
| Tensile, lb/inch | 3.17 | 10.7 |
| Stretch, % | 6.0 | 3.4 |
| Breaking Length, m | 955 | 3255 |

EXAMPLE 6

The procedure of Example 4 was repeated employing polypropylene having an intrinsic viscosity of 1.7 dl/g (Hercules Profax 6301). In one run, the mixture contained 500 ml water; 2,500 ml n-hexane; 200 grams polypropylene, and 2 grams of Gelvatol 20–30 polyvinyl alcohol. This mixture was heated to 140° C and held there for one hour prior to flashing. A second run was identical to the first run except the polypropylene was employed in the amount of 100 grams. A third run was identical to the second run except the temperature of the mixture was raised to 175°–180° C prior to flashing. In all cases a fibrous product was obtained.

EXAMPLE 7 AND COMPARATIVE EXAMPLE

Two runs were made in order to compare the fibrous products made in accordance with this invention (Run No. 1) with the fibrous product produced under equivalent fiber preparation conditions but employing a flash mixture wherein the water is in the continuous phase (Run No. 2)

In both of these runs a 10 liter steam jacketed vessel was employed which had an inlet and outlet for nitrogen, an electrode for measuring conductivity and a centrally located vertical agitator shaft with a mechanical seal. A 4 inch diameter upward pumping pitch bladed turbine was positioned on the shaft 2 inches from the bottom of the vessel. Two 4 inch diameter straight bladed impellers were positioned on the shaft 6 inches and 10 inches above the vessel bottom, respectively. A 4 inch diameter downward pumping turbine and a 3 inch diameter downward pumping turbine were positioned on the shaft 14 inches and 18 inches above the vessel bottom, respectively. Three vertical baffles were spaced at equidistant radial positions extending inward from the vessel wall. This vessel design is capable of providing vigorous agitation throughout the entire mass of the mixture so that regions of low agitation are avoided.

This design ensures that the entire mixture is agitated, and avoids regions of little agitation which could encourage the establishment of a continuous water phase. Exiting from the bottom of the vessel was a ¾ inch diameter pipe having a ¾ inch ball valve located therein two inches below the vessel bottom. Immediately adjacent the ball valve was a nozzle consisting of a brass plug 28 mm in length with a centrally located hole 1.78 mm in diameter drilled therethrough. The nozzle plug was inserted in a ¾ inch internal diameter pipe 8 feet long which exited into a flash tank maintained at atmospheric pressure.

In both runs, the materials used to form the flash mixture were the same, namely 4,800 ml of n-hexane, 384 gms of polyethylene (Mitsui Hyzex 5000P, intrinsic viscosity of 2.0), 3,200 ml water and 7.7 gms of Gelvatol 20-30 polyvinyl alcohol (88% hydroylzed, molecular weight of 10,000). However, the manner of formulating this flash mixture from these materials was different for the two runs.

In Run No. 1, (Example of the Invention), the vessel was first charged with the solvent and polymer, the vessel was then sealed and purged with nitrogen and the contents heated to about 144° C and held at this temperature with the agitator revolving at 1000 rpm for about 2 hours to ensure complete polymer dissolution. Then the PVA was dissolved in the water in a separate vessel and this solution heated to approximately 144° C. The heated solution was then charged under pressure to the vessel containing the heated polymer solution at a rate of approximately 500 ml per minute. This slow and gradual addition rate caused the water to assume and remain the dispersed phase in the mixture. During charging of the PVA containing water the agitator in the vessel containing the polymer solution was maintained at 1000 rpm. Agitation of this mixture was continued for 15 minutes and then the conductivity of the mixture was measured and found to be essentially 0 millivolts, showing that the water was a discontinuous phase in the mixture.

In Run No. 2 (Comparative Example) formulation of the flash mixture was carried out by the procedure of Example 4, i.e. the vessel used for Run No. 1 was charged with all of the material at room temperature and then this mixture was heated and agitated at the same rate used in Run No. 1 to effect polymer dissolution and to disperse the PVA - containing water. After agitation at between 110° and 140° C for 2 hours, the conductivity of this mixture was measured and found to be in excess of 100 millivolts, showing that the water was the continuous phase and the polymer solution the discontinuous phase.

In each of Runs 1 and 2 the mixture formed as described was then heated at 144° C and flashed at that temperature and at a pressure of 160 psig by the procedure of Example 4 and the flashed material was refined using the equipment described in Example 4 except that the refiner plates used were Sprout Waldron pattern P-29-76-B. Refining was conducted at a consistency in water of approximately 3%. The gap settings between the plates were as follows: first pass, 6.4 mm; second pass, 0.6 mm; third pass, 0.3 mm; fourth and additional passes, 0.05 mm. The flashed material from each run was refined in this fashion until the fibrous product attained a Classified Fiber Length (CFL) of approximately 1.2 mm. A portion of the products from each run was then refined an additional extent by this procedure to produce a fibrous product having a Classified Fiber Length (CFL) of approximately 0.8 mm. The properties of these fibrous products and handsheets made therefrom (as described in Example 1) were measured and compared as follows:

Table 7A

| Property | FIBER PROPERTIES Products of Approximately 0.8 mm CFL Run 1 | Run 2 | Products of Approximately 1.2 mm CFL Run 1 | Run 2 |
|---|---|---|---|---|
| Classified Fiber Length (CFL) mm | 0.78 | 0.88 | 1.17 | 1.16 |
| Fiber Fractions | | | | |
| % on 20 mesh screen | 1.6 | 0.8 | 14.9 | 6.9 |
| % on 35 mesh screen | 21.0 | 25.4 | 31.6 | 41.3 |
| % through 150 mesh screen | 23.0 | 17.8 | 14.2 | 12.2 |
| Coarseness, decidrex | 12.6 | 10.9 | 13.7 | 19.5 |
| Surface Area, $m^2/gm$ | 9.48 | 8.64 | 8.94 | 8.64 |
| Drainage Factor sec/gm | 31.6 | 9.2 | 16.2 | 6.7 |

Table 7B

| Property | HANDSHEET PROPERTIES Handsheets of 100% polyethylene fibers of approx. 0.8 mm CFL. Run 1 | Run 2 | Handsheets of 100% polyethylene fibers of approx. 1.2 mm CFL. Run 1 | Run 2 | Handsheets of 50% polyethylene fibers of approx. 0.8 mm CFL & 50% bleached alder kraft fibers Run 1 | Run 2 | Handsheets of 50% polyethylene fibers of approx. 1.2 mm CFL & 50% bleached alder kraft fibers. Run 1 | Run 2 |
|---|---|---|---|---|---|---|---|---|
| Density, gm/cc | 0.484 | 0.407 | 0.416 | 0.381 | 0.604 | 0.549 | 0.539 | 0.518 |
| Tear g/sheet | 48.0 | 22.4 | 47.2 | 23.2 | 40.8 | 35.2 | 48.8 | 35.2 |
| Breaking length m | 1855 | 859 | 1346 | 758 | 2914 | 2621 | 2763 | 2505 |
| Stretch, % | 18.8 | 9.5 | 13.0 | 8.6 | 3.6 | 3.6 | 3.0 | 3.4 |
| TEA, $kg\text{-}cm/cm^2$ | 0.169 | 0.042 | 0.087 | 0.029 | 0.044 | 0.04 | 0.036 | 0.036 |
| Internal Bond Scott Units (metric) | 153 | 105 | 102 | 110 | 171 | 169 | 173 | 172 |

We claim:

1. A process of making discrete fibers comprising:

A. forming a mixture comprising:

1. a polymer capable of forming fibers and of being swollen or dissolved by a solvent,
2. an organic solvent, in an amount at least greater by weight than said polymer, which is a solvent for said polymer at elevated temperatures and which is capable of forming therewith a phase which is substantially water immiscible and
3. water in an amount capable of forming a dispersed and non-continuous phase in said mixture in which the water is present as a dispersed phase and not as a continuous phase in the mixture;

B. at a temperature sufficiently high that the polymer is present in at least a swollen state but below the critical temperature of the solvent and below the temperature at which the polymer decomposes and at autogeneous or higher pressure;

C. agitating the mixture sufficiently to maintain the water as a dispersed and non-continuous phase therein; and D. passing the mixture through a nozzle into a zone of lower pressure which is at a temperature and pressure enabling said solvent to vaporize, thereby causing the formation of a fibrous product of discrete fibers.

2. The process of claim 1 wherein the water is present in an amount greater than 1 volume percent but less than 70 volume percent of the mixture and wherein the mixture is heated to a temperature above the melt dissolution temperature of the polymer in the solvent but less than the critical temperature of the solvent.

3. The process as in claim 2 and wherein the water is present in an amount less than 30 volume percent of the mixture.

4. A process as in claim 2 wherein the water is present in the formed mixture in an amount which would have a greater tendency to form a continuous phase rather than a dispersed phase and wherein, in forming said mixture, a solution of the polymer and solvent is first formed and then the water is added to said solution while the solution is under sufficient agitation to disperse the water therein as a dispersed phase.

5. A process as in claim 4 and wherein the water is present in the formed mixture in an amount of 30 volume percent or greater.

6. The process of claim 2 and wherein the mixture additionally contains an at least partially water soluble water-dispersing agent for the fibers to be formed in an amount of about 0.1% to 15% by weight of the polymer to aid dispersion of the water as the dispersed phase.

7. The process as in claim 6 and wherein the water-dispersing agent is polyvinyl alcohol having a degree of hydrolysis greater than about 77% and having a viscosity in 4% aqueous solution at 20° C greater than about 2 centipoises present in an amount between 0.1 and 5% by weight of the polymer.

8. A process as in claim 2 and wherein said polymer is an at least partially crystalline polymer and is present in an amount between about 2% and 30% by weight of the solvent.

9. A process as in claim 8 and wherein said polymer is a polyolefin.

10. A process as in claim 9 and wherein said polyolefin has an intrinsic viscosity greater than about 0.7 dl/gram, is present in an amount between about 5% and 15% by weight of the solvent and is selected from the group consisting of polyethylene and polypropylene.

11. A process as in claim 2 and wherein the solvent has a boiling point at the pressure in the zone of reduced pressure which is lower than the melting range of the polymer.

12. A process as in claim 9 and wherein the mixture is heated to between about 120° C and 160° C.

13. A process of making discrete fibers comprising:

A. forming a mixture comprising:

(1) an at least partially crystalline polyolefin, (2) a substantially water immiscible organic solvent for the polyolefin in an amount between 70% and 98% of the combined weight of the polyolefin and solvent, (3) water in an amount greater than 1% but less than 70 volume percent of the mixture; in which the water is present as a dispersed and not as a continuous phase in the mixture;

B. at a temperature above the melt dissolution temperature of the polyolefin but less than the critical temperature of the solvent and decomposition temperature of the polyolefin and at autogeneous pressure or higher;

C. agitating the mixture sufficiently to maintain the water as a dispersed and non-continuous phase therein; and D. passing the mixture through a nozzle into a zone of lower pressure which is at a temperature and pressure enabling said solvent to vaporize, thereby causing the formation of a fibrous product of discrete fiber.

14. A process as in claim 13 and wherein said solvent has a boiling point at the pressure in the zone of reduced pressure which is lower than melting point range of the polyolefin.

15. A process as in claim 14 and wherein the mixture additionally contains a hydrophillic water-dispersing agent in an amount of about 0.1% to 15% by weight of the polymer to aid dispersion of the water as the dispersed phase.

16. The process as in claim 15 and wherein the water-dispersing agent is polyvinyl alcohol having a degree of hydrolysis greater than 77% and having a viscosity in 4% aqueous solution greater than about 2 centipoises present in an amount between 0.1 and 5% by weight of the polymer.

17. A process as in claim 14 and wherein the water as present in the mixture is less than 30% by volume of the mixture.

18. A process as in claim 14 and wherein the polyolefin is present in the amount of about 5% to 15% by weight of the solvent, has an intrinsic viscosity greater than about 0.7 dl/gram and is selected from the group consisting of polyethylene and polypropylene, the mixture is heated to a temperature of between about 120° C and 160° C and the zone of lower pressure is at about atmospheric or lower pressure.

19. A process of forming discrete fibers comprising:

A. forming a solution comprising:

(1) an at least partially crystalline polyolefin and (2) a substantially water immiscible organic solvent for the polyolefin in an amount between 70% and 98% of the combined weight of the polyolefin and solvent at a temperature above the melt dissolution temperature of the polyolefin in the solvent;

B. adding to said solution water, at a temperature above the melt dissolution temperature of said polyolefin and in an amount between 30% and 70% by volume of the mixture, while the solution is under sufficient agitation to disperse the water therein as a dispersed and non-continuous phase;

C. maintaining the thus formed mixture under agitation at a temperature above said melt dissolution temperature but below the critical temperature of the solvent and below the temperature at which the polymer decomposes and at autogeneous pressure or higher; and D. passing the mixture through a nozzle into a zone of lower pressure which is at a temperature and pressure enabling said solvent to vaporize, thereby causing formation of a fibrous product of discrete fibers.

20. The process as in claim 19 and wherein the solvent has a boiling point at the pressure of the reduced pressure zone which is lower than the melting range of the polyolefin.

21. The process as in claim 20 and wherein said water added to said solution contains a hydrophillic water dispersing agent in an amount of 0.1 to 15% by weight of the polymer to aid dispersion of the water as the dispersed phase.

22. The process as in claim 21 and wherein the water dispersing agent is polyvinyl alcohol having a degree of hydrolysis greater than 77% and having a viscosity in 4% aqueous solution greater than about 2 centipoises present in an amount between 0.1 and 5% by weight of the polymer.

23. A process as in claim 22 and wherein the polyolefin is present in the amount of about 5% to 15% by weight of the solvent and is selected from the group of polyethylene and polypropylene, the mixture is heated to between 120° C and 160° C prior to passage through said nozzle and the zone of reduced pressure is at about atmospheric or lower pressure.

24. A process for preparing a fibrous synthetic polymer material, which comprises: mixing a diluent solution of 2-30 percent by weight of a hydrophobic polymer selected from the group consisting of polyethylene, polybutene, poly-methylpentene, polyamides, polyesters and polyacrylonitrile in a diluent of cyclohexane, hexane, octane, benzene, methylene chloride, alcohols or amides with an aqueous solution of polyvinyl alcohol and a surface active agent to form a water-in-oil emulsion, wherein the water to diluent ratio ranges from 1:10 to 1:1 by volume; heating said emulsion to a temperature above the melt dissolution point of said hydrophobic polymer under high pressure, and passing the heated emulsion through a nozzle into a lower pressure zone thereby volatilizing said diluent.

* * * * *